US005495639A

United States Patent [19]

Wartian

[11] Patent Number: 5,495,639

[45] Date of Patent: Mar. 5, 1996

[54] DOOR CLOSING APPARATUS

[76] Inventor: George Wartian, 34938 Island View Dr., E., Mt. Clemens, Mich. 48045

[21] Appl. No.: 349,797

[22] Filed: Dec. 6, 1994

[51] Int. Cl.[6] ..... E05F 1/08

[52] U.S. Cl. ..... 16/79; 16/80

[58] Field of Search ..... 16/80, 79, 72, 16/75, 76, 49, 51, 58, 61, 62, 63, DIG. 17, DIG. 21, DIG. 9

[56] References Cited

U.S. PATENT DOCUMENTS

| | | | |
|---|---|---|---|
| 1,583,149 | 5/1926 | Hill | 16/80 |
| 2,102,321 | 12/1937 | Keene | 16/80 |
| 2,634,454 | 4/1953 | Altenburger | 16/76 |
| 2,651,074 | 9/1953 | Slopa et al. | 16/80 |
| 4,817,238 | 4/1989 | Liu | 16/58 |

*Primary Examiner*—Maurina T. Rachuba
*Assistant Examiner*—Chuck Y. Mah
*Attorney, Agent, or Firm*—Barnes, Kisselle, Raisch, Choate, Whittemore & Hulbert

[57] ABSTRACT

A door closing apparatus for closing a hinged door in which a door closer is attached to a spring unit which in turn is mounted on the door frame by a bracket. The spring unit has a torsion spring within a housing which rotates on the bracket. One end of the spring is affixed to the housing and the other end of the spring is held from rotating by a ratchet type mechanism. The ratchet mechanism may be rotated to adjust the spring. The door closer is capable of adjustment by rotating the closer cylinder. In order to rotate the cylinder, it must be disconnected from the door. A stop on the bracket engages an abutment on the housing to prevent the closer from snapping back when it is disconnected from the door. The stop and abutment are also of assistance when adjusting the tension of the spring on the housing.

7 Claims, 3 Drawing Sheets

DOOR CLOSING APPARATUS

FIELD OF INVENTION

This invention relates generally to a door closing apparatus for a hinged door.

BACKGROUND AND SUMMARY OF THE INVENTION

Door closers are designed to close an opened door after the door is released. The strength of the door closer may vary, depending upon such factors as the weight of the door and even upon individual preferences.

The present invention provides door closing apparatus incorporating a spring unit which is readily and easily adjusted to change the amount of force available to close the door.

In accordance with the specific embodiment about to be described, a door closer is attached to a spring unit which in turn is mounted on the door frame by a bracket. The spring unit comprises a torsion spring within a barrel-shaped housing which is mounted for rotation on the bracket. A retainer affixed to the housing engages one end of the spring to compel that spring end to rotate with the housing. A second retainer for the other end of the spring is rotatably mounted on the housing. This second retainer may be held against rotation with respect to the bracket by a ratchet which has a ratchet wheel on the second retainer and a retractable dog on the bracket. The ratchet wheel may be rotated by a tool when the dog is retracted to adjust the tension in the spring, while holding the housing against rotation.

Preferably, the door closer is capable of being adjusted to change the speed at which the door closes by rotating the closer cylinder. To rotate the cylinder, it must be disconnected from the door. A stop on the bracket engages an abutment on the housing to prevent the closer from snapping back when disconnected from the door. The stop and abutment are also of assistance when adjusting the tension on the spring in the housing.

One object of this invention is to provide a door closing apparatus having the foregoing features.

Another object is to provide a door closing apparatus which is composed of a relatively few simple parts, is rugged and durable in use, is easily adjusted, and can be inexpensively manufactured and assembled.

These and other objects, features and advantages of the invention will become more apparent as the following description proceeds, especially when considered with the claims and accompanying drawings.

DETAILED DESCRIPTION OF THE PREFERRED EMBODIMENT

Figure 1:
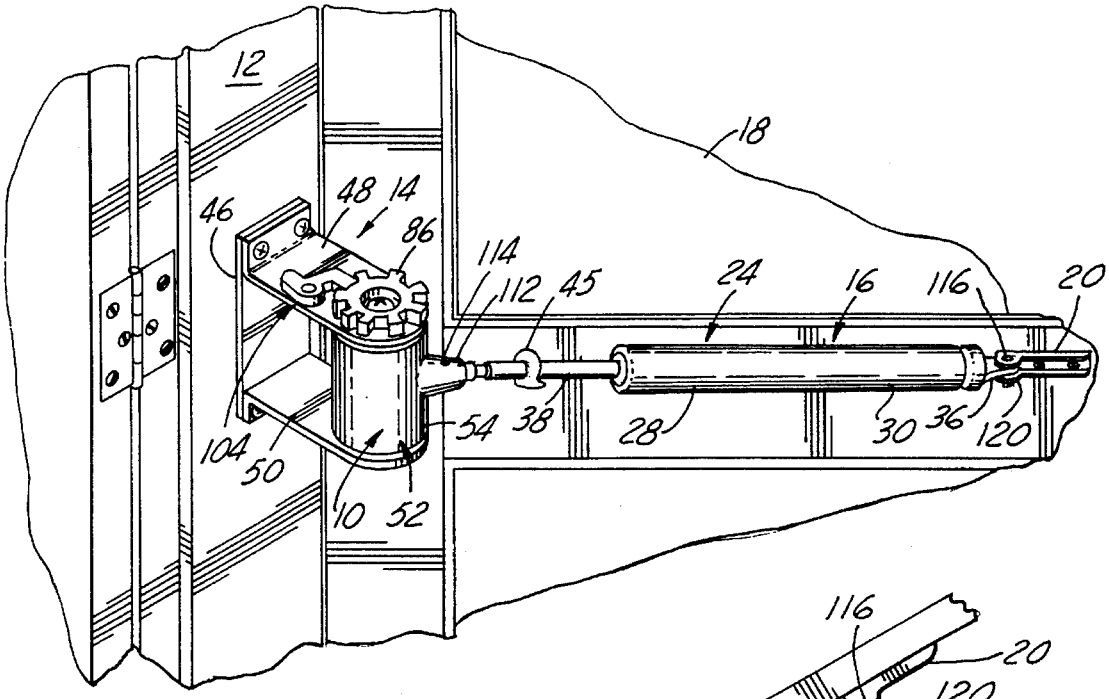
FIG. 1 is a fragmentary perspective view showing the door closing apparatus of this invention applied to a hinged door.

Referring now more particularly to the drawings, the apparatus of this invention comprises a spring unit 10 mounted on a door frame 12 by a bracket 14, and an extensible and retractible door closer 16 having one end attached to the spying unit 10 and the other end attached to the door 18 by a mullion bracket 20. The door 18 is hinged to the door frame 12 for swinging movement by a hinge 22.

The door closer 16 is in the form of an elongated piston-cylinder assembly 24 having a piston 26 reciprocable within an elongated cylinder 28. The cylinder 28 comprises a tubular shell 30 closed at the ends by heads 32 and 34. The head 34 has a flange extension 35 adapted to be connected to the mullion bracket 20 of the door. A piston rod 38 extends from the piston 26 through an opening 40 in the head 32. The piston rod 38 is threaded in a central, threaded through passage 39 in the piston 26. A compression coil spying 41 within the cylinder 28 is compressed between the piston 26 and the cylinder head 32 and tends to shorten the piston-cylinder assembly and thus urge the door toward its closed position.

During movement to closed position, a fluid such as oil in the cylinder 28 passes from the head end to the rod end thereof through the restricted bleed passage 43 in the piston, thus slowing the closing movement of the door. The bleed passage 43 opens into the threaded through passage 39 in the piston and may be partially restricted by the end of the piston rod 38. When the door is pulled open, oil can pass from the rod end of the cylinder to the head end across the notches 42 around the periphery of the piston, as well as through the bleed passage 43. The flexible rubber disc 44 on the piston prevents oil from passing through the notches 42 when the door is swung to closed position and the piston-cylinder assembly is shortened so that all of the oil has to pass through the restricted bleed orifice. However, the flexible disc 44 permits a relatively free passage of oil across the piston through the piston notches 42 when the piston-cylinder assembly is extended.

The bleed passage 43 may be restricted a greater or a lesser amount by rotating the piston 26 relative to the piston rod 38, changing the amount that the end of the piston rod covers the bleed passage. Although the piston 26 is reciprocable within the cylinder 28, the piston turns with the cylinder so that the amount of bleed passage restriction can be changed by merely rotating the cylinder 28.

A hold open washer 45 is slidably mounted on the piston rod 38 and may be slid up against the end of cylinder 28 to hold the door open.

The bracket 14 comprises a mounting plate 46 secured to the door frame 12 by fasteners 47. A pair of vertically spaced horizontal arms 48 and 50 extend outwardly from the mounting plate.

The spring unit 10 comprises an elongated, vertical, barrel-shaped housing 52 having a cylindrical side wall 54 of uniform circular cross-section throughout its length which is closed at the lower end by an end wall 56 and is open at the top 57. An elongated torsion coil spring 58 extends lengthwise within the housing and has one end 60 engaged by a retainer 62 formed on the inner surface of the end wall 56. The retainer 62 is formed with four equally angularly spaced notches or recesses 64, any one of which may be engaged by the end 60 of the spring 58 to retain the spring end against rotation with respect to the housing.

The spring unit 10 has a washer 72 for the open end 57 of the housing which is in the form of a ring-like disc of plastic or other suitable anti-friction material and has an annular radially outwardly extending flange 74 which rests lightly and loosely on the top edge of the housing 52. This assembly of parts, including the housing 52 with the retainer 62 and spring 58 therewithin and the washer 72 over the open end is disposed between the two arms 48 and 50 of the bracket. It will be noted that there is a second washer 76 between the lower arm 50 of the bracket and the lower end wall 56 of the housing, also of a suitable anti-friction material.

A second retainer 78 for the other end 79 of the spring 58 extends through an opening 80 in the upper bracket arm 48 and through a hole 81 in the washer 72 into the interior of the housing. This retainer 78, like retainer 62, also has four equally angularly spaced notches 82 for the reception of the other spring end 79. Integral with the retainer 78 is a ratchet wheel 86 which is disposed on the outer side of the bracket arm 48 and is formed with a plurality of equally spaced teeth 88 around its periphery with spaces or notches 90 between the teeth. The second retainer 78 is assembled with the housing 52 after the housing is placed between the arms 48 and 50 of bracket 14.

The spring unit is secured to the bracket by a long screw 92 which extends lengthwise through the housing 52, through central openings 94 and 96 in the two retainers and through the washers 72 and 76. A head 98 on the upper end of the screw fits into a recess 100 in the retainer 78. A nut 102 is threaded on the lower end of the screw to retain the spring unit 10 between the bracket arms 48 and 50 but permitting rotation thereof. The two washers 72 and 76 allow for a relatively free rotation of the spring unit.

The retainer 78 is held from rotation relative to the bracket arm 48 by a dog or latch 104 which is pivoted to the bracket arm by a pivot pin 106. The dog has a handle portion 108 at one end and a ratchet wheel engaging portion or nose 110 at the opposite end. When the nose 110 of the dog is extended into one of the notches 90 in the ratchet wheel 86, the retainer 78 is held from rotation with respect to the bracket 14.

The housing has an integral tubular socket 112 projecting radially outwardly from its side wall into which the end of the piston rod 38 extends. A pin 114 extends through registering holes in the socket 112 and in the end of the piston rod 38 end to releasably secure the parts together. A pin 116 extends through a pair of ears 120 on the mullion bracket 20 and through a hole 122 in the flange 36 on the head 34 of the cylinder 28 to releasably connect the cylinder to the mullion bracket.

Figure 2:
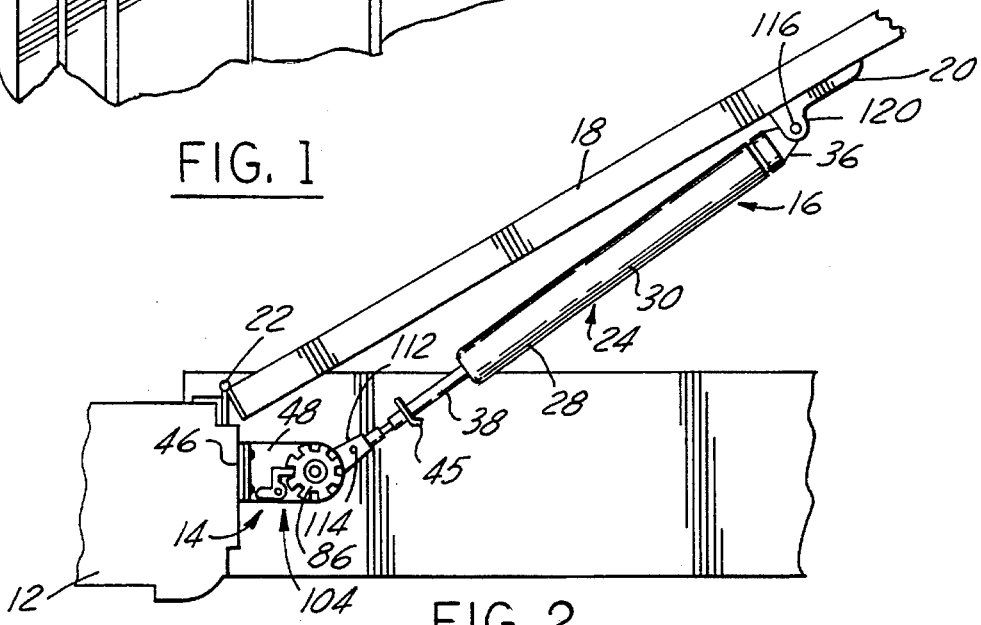
FIG. 2 is a fragmentary top view of the apparatus shown in FIG. 1.
Figure 3:
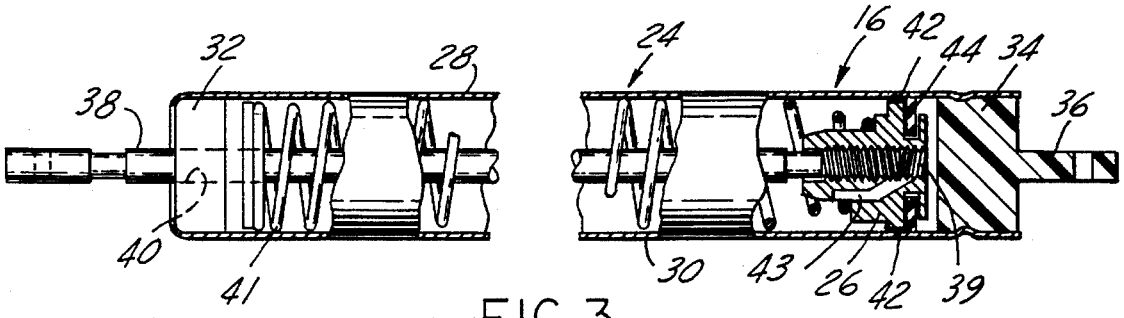
FIG. 3 is an enlarged elevational view with parts in section showing the door closer which is part of the door closing apparatus.
Figure 7:
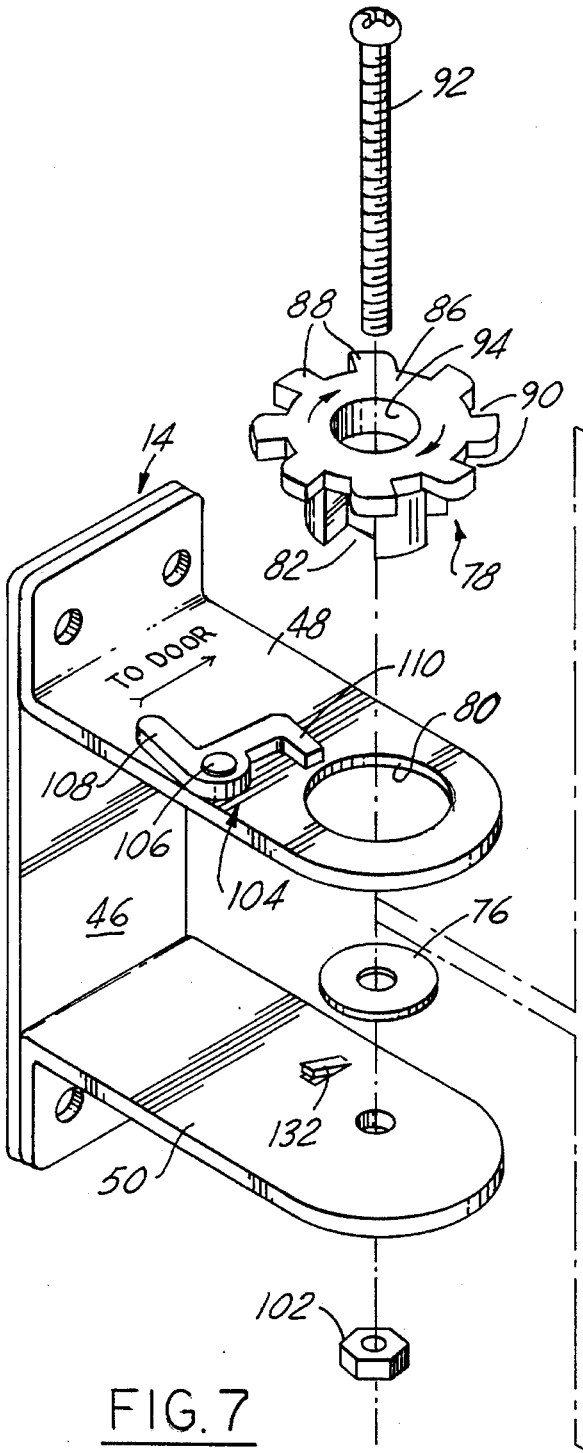
FIG. 7 is an exploded view of the spring unit shown in perspective.
Figure 4:
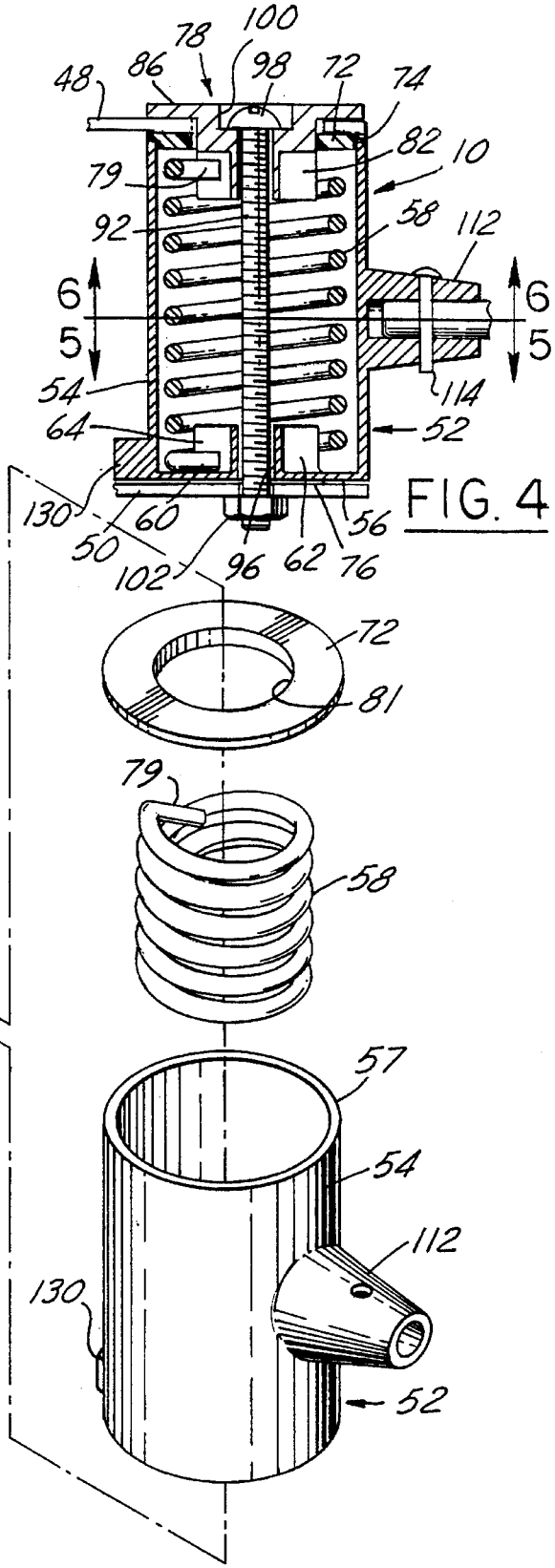
FIG. 4 is an enlarged sectional view of the spring unit which also is a part of the apparatus of this invention.
Figure 8:
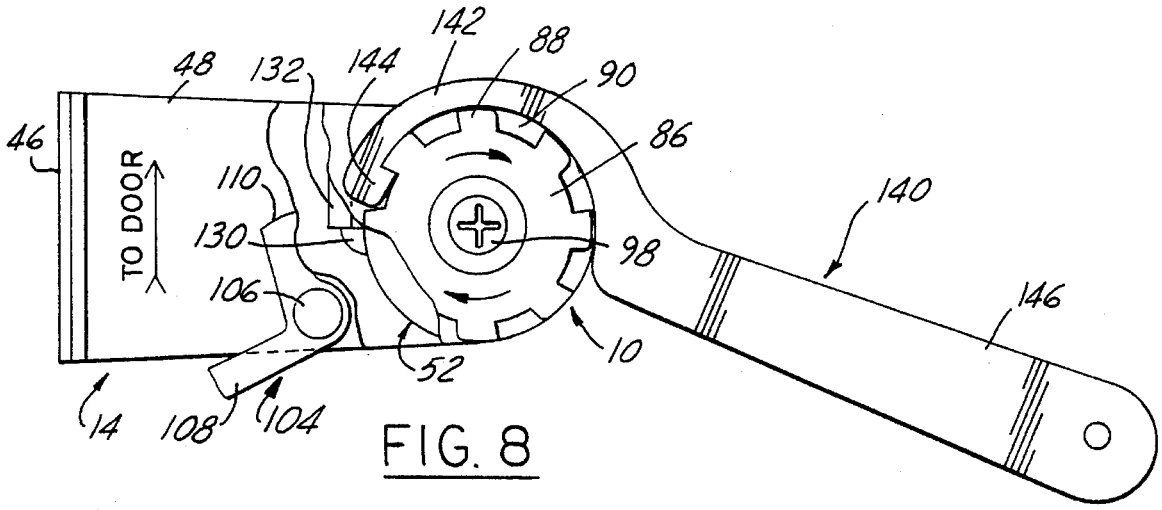
FIG. 8 is a top view of the spring unit and mounting bracket shown in the process of being adjusted as to tension by a suitable tool.
Figure 5:
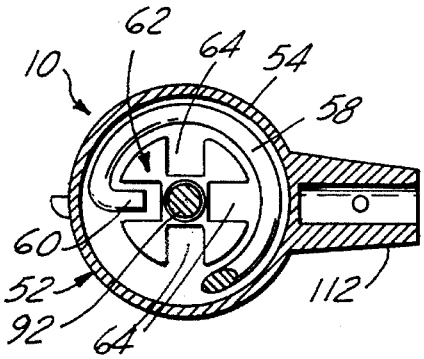
FIG. 5 is a sectional view taken on the line 5—5 in FIG. 4.
Figure 9:
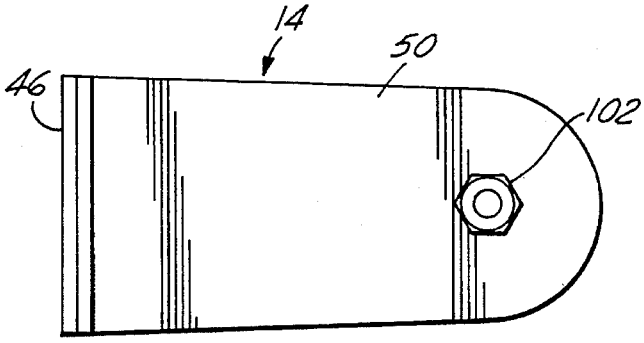
FIG. 9 is a bottom view of the bracket.
Figure 6:
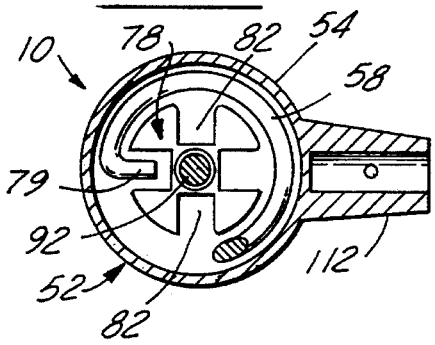
FIG. 6 is a sectional view taken on the line 6—6 in FIG. 4.
Figure 10:
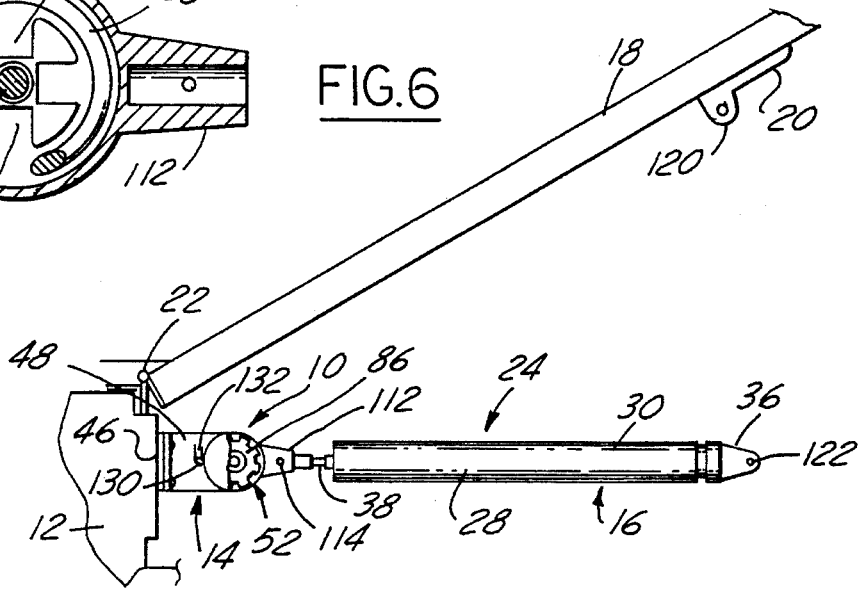
FIG. 10 is a view similar to FIG. 2, but with the door closer disconnected from the door and parts broken away.

It will be seen that when the door is swung open, the spring unit housing 10 will be caused to rotate counterclockwise in FIGS. 1 and 2. The lower end 60 of the spring 58 will rotate with the housing, but the upper end 79 of the spring will be held from rotation by reason of the fact that the upper spring retainer 78 with which it is engaged is held from rotation by the ratchet wheel 86 and dog 104. Thus, as the door is opened, the tension of the spring increases and resists opening movement.

The tension in the spring 58 can be readily and easily changed. This is accomplished by holding the housing 52 from rotating relative to the bracket 14, withdrawing the dog 104 from a notch in the ratchet wheel 86, rotating the ratchet wheel to a new position, and advancing the nose 110 of the dog 104 back into engagement with another one of the notches 90 of the ratchet wheel. The housing 52 will be kept from rotating while this adjustment is made, as long as the closer is connected to the door.

To hold the housing 52 from turning while making the adjustment when the closer is disconnected from the door, the housing has an abutment 130 extending radially outwardly from its side wall 54 near the lower end thereof, and the lower bracket arm 50 has a stop in the form of a tang 132 cut from the material of the arm 50 and bent up so that it will be contacted by the abutment when the housing is turned clockwise in FIGS. 1, 2, 8 and 9, preventing further clockwise rotation.

To make an adjustment of spring tension, a tool 140 may be used. The tool has an arcuate portion 142 curved on the same radius as the ratchet wheel 86 and provided with a radially inwardly extending end portion 144 which will fit in any of the ratchet wheel notches 90. The tool 140 has a handle 146 which can be used, when the dog 104 is withdrawn, to apply clockwise torque on the ratchet wheel, to turn it and the spring end 79 clockwise and thus increase spring tension. The tool can also, of course, be used to reduce spring tension by backing off in a counterclockwise direction. The tang 132 engages the housing abutment 130 to prevent rotation of the housing during the adjustment.

To make an adjustment in the size of the bleed passage 43 and hence the amount of closing force on the door by the closer 16, the pin 116 is removed to disconnect the closer from the door. The cylinder 28 can then be rotated to turn the piston 26 on piston rod 38 to make the adjustment. The tang 132 will be engaged by housing abutment 130 to prevent the closer from snapping back when the pin 116 is removed.

What is claimed is:

1. Door closing apparatus for a door hinged to a fixed frame comprising:

a spring unit, a bracket for mounting said spring unit on the fixed frame, said spring unit comprising a housing having an axis of rotation, means mounting said housing on said bracket for rotation about said axis, a spring in said housing having a first end and a second end, a first retainer affixed to said housing and engaging the first end of said spring to compel said first end of said spring to rotate with said housing, a second retainer rotatably mounted on said housing and engaging said second end of said spring, releasable means for securing said second retainer in adjusted rotative position with respect to said bracket, so that when said housing is rotated in one direction, the stress on said spring is increased, a door closer having a first end connected to said housing and having a second end adapted to be connected to the door and operative, when the door is swung open, to rotate said housing in said one direction, and means for holding said housing from rotation beyond a selected point in the opposite direction so that said closer may be safely disconnected from the door for any reason, said holding means comprising a stop on said bracket, and an abutment on said housing engageable with said stop when said housing is rotated in said opposite direction to prevent further rotation thereof in said opposite direction.

2. Door closing apparatus as defined in claim 1, wherein said releasable means comprises a ratchet including a ratchet wheel affixed to said second retainer and having circumferentially spaced teeth around its periphery, and a dog on said bracket releasably engageable in the spaces between said teeth to lock said ratchet wheel and the second retainer affixed thereto in adjusted rotative position.

3. Door closing apparatus for a door hinged to a fixed frame comprising:

a spring unit, a bracket for mounting said spring unit on the fixed frame, said bracket having a pair of laterally spaced bracket arms, said spring unit comprising an elongated barrel-shaped housing having a closed end and an open end and a central axis of rotation extending from one end thereof to the other, means mounting said housing on said bracket between said bracket arms for rotation about said axis, a torsion spring in said housing having a first end adjacent the closed end of said housing and a second end adjacent the open end of said housing, a first retainer affixed to the closed end of said housing and engaging said first end of said spring to compel said first end of said spring to rotate with said housing, a second retainer rotatably mounted in the open end of said housing and engaging said second end of said spring, releasable means for securing said second retainer in adjusted rotative position with respect to said bracket so that when said housing is rotated in one direction, the stress on said spring is increased, an elongated extensible and retractible door closer having a first end connected to said housing and having a second end adapted to be connected to the door and operative, when the door is swung open, to become extended and to rotate said housing in said one direction, and means for holding said housing from rotation beyond a selected point in the opposite direction so that said end of said closer may be safely disconnected from the door for any reason, said holding means comprising a stop on said bracket, and an abutment on said housing engageable with said stop when said housing is rotated in said opposite direction to prevent further rotation thereof in said opposite direction.

4. Door closing apparatus as defined in claim 3, wherein said releasable means comprises a ratchet including a ratchet wheel affixed to said second retainer and having circumferentially spaced teeth around its periphery, and a pivoted dog on said bracket releasably engageable in the spaces between said teeth to lock said ratchet wheel and the second retainer affixed thereto in adjusted rotative position.

5. Door closing apparatus as defined in claim 4, wherein said ratchet wheel is on the outer side of one of said bracket arms and is connected to said second retainer through a hole in said one bracket arm, and said dog is pivotally connected to said one bracket arm.

6. Door closing apparatus as defined in claim 5, and further including a first washer between the open end of said housing and said one bracket arm through which said second retainer extends, and a second washer between the closed end of said housing and the other of said bracket arms, said washers being made of a relatively anti-friction material to facilitate rotation of said housing relative to said bracket arms.

7. Door closing apparatus as defined in claim 6, wherein said stop is a tang cut from the material of the other of said bracket arms.

* * * * *